US005353616A

United States Patent [19]

Fischer et al.

[11] Patent Number: 5,353,616

[45] Date of Patent: * Oct. 11, 1994

[54] PITTSBURGH SEAM CLOSER HAVING SINGLE SEAMING ROLL

[75] Inventors: Herbert J. Fischer, Imperial; Dale R. Foster, Barnhart; John A. Fahland, Desoto, all of Mo.

[73] Assignee: Engel Industries, Inc., St. Louis, Mo.

[ * ] Notice: The portion of the term of this patent subsequent to Dec. 11, 2009 has been disclaimed.

[21] Appl. No.: 690,528

[22] Filed: Apr. 24, 1991

[51] Int. Cl.[5] ..... B21D 39/02

[52] U.S. Cl. ..... 72/51; 72/176; 72/214; 29/521; 29/243.5

[58] Field of Search ..... 72/51, 176, 214, 52; 29/243.5, 521, 819, 514, 283.5

[56] References Cited

U.S. PATENT DOCUMENTS

| | | | |
|---|---|---|---|
| 2,254,289 | 9/1941 | Jensen | 72/214 |
| 2,998,738 | 9/1961 | Crine et al. | 72/51 |
| 4,424,618 | 1/1984 | Stubbings | 29/509 |
| 4,497,189 | 2/1985 | Larson | 72/51 |

FOREIGN PATENT DOCUMENTS

| | | | |
|---|---|---|---|
| 2358177 | 11/1973 | Fed. Rep. of Germany | 29/243.5 |
| 0086031 | 5/1986 | Japan | 72/176 |
| 0159225 | 7/1986 | Japan | 72/176 |
| 0700230 | 11/1979 | U.S.S.R. | 72/176 |
| 1169772 | 7/1985 | U.S.S.R. | 72/52 |

*Primary Examiner*—Lowell A. Larson
*Assistant Examiner*—Michael J. McKeon
*Attorney, Agent, or Firm*—Jerome A. Gross

[57] ABSTRACT

For closing Pittsburgh-type rectilinear seams, as in conventional sheet metal heating and air conditioning ducts. The present machine, with only a single seaming roll, closes seams through 45° to 90° on an advancing stroke, and burnishes them on the return stroke. The machine functions without adjustment throughout substantially the entire range of sheet metal thicknesses normally utilized. Of particular advantage in manufacturing duct sections having integral end flanges, only an initial short length of seam need be peened manually before the duct elements to be seemed are clamped in place for completion. Workplace noise is greatly reduced.

10 Claims, 7 Drawing Sheets

PITTSBURGH SEAM CLOSER HAVING SINGLE SEAMING ROLL

BACKGROUND OF THE INVENTION

1. Field of the Invention

This invention relates to the mechanical closing of rectilinear Pittsburgh lock side seams of metal duct sections, and most advantageously to the side seams of that type of duct section having integral end flanges.

2. Description of Related Art

"Pittsburgh" type lock joints are commonly used to join the seams of metal ducts, whether the sections are rectilinear, tapered or rounded. In all these types, seam closing has traditionally been accomplished by manually hammering the margin of the seam against the duct wall (peening). Disadvantages of such peening include the time required and the almost intolerable noise produced.

For closing rectilinear longitudinal joints, a three-roll seam closer machine has recently been made available by Iowa Precision Industries, of Cedar Rapids, Iowa. This machine mounts, on a carriage, a succession of three rolls, the first of which bends the outstanding margin to be closed through an approximate 30° angle, the second bends it to 60° and the third closes it to 90°. A disadvantage of this type of machine, especially significant where the duct sections have integral outstanding end flanges, is that a substantial length—at least several inches at each end of the seam—must first be peened, to allow for the width taken up by the three carriage-mounted rollers which cannot pass these end flanges.

SUMMARY OF THE INVENTION

It is an object of this invention to provide a machine for closing rectilinear Pittsburgh seams with a compact roll carriage which minimizes the amount of manual peening necessary to close Pittsburgh type seams of duct sections, and is especially well suited for closing duct sections which have integral flanges. It is a further object that the machine provide tightly closed seams which are effectively burnished, both for neat appearance and to minimize leakage of air therethrough; and which requires no adjustment over a broad range of sheet metal thicknesses.

In using the present single roll machine, duct sections are preliminarily assembled by peening at least the starting ends of seams to be formed, over a length not substantially greater than the diameter of the roll. The duct preliminarily assembled is then positioned on the machine, clamped with the peened seam end abutted against the face of the seamer roll. The carriage is then powered to advance along a track so that the seamer roll raises the previously outstanding margin first to at least 45° from its unformed position through the entry portion of its forward stroke (and in the preferred embodiment, through the 45° position to a 90° position). At the end of the forward stroke, the carriage is reversed with the roll rotating in the opposite sense, and the margin is then pressed and burnished at 90°, closing the seam tightly and presenting a smoothly finished appearance.

In the preferred embodiment of the invention, the seamer roll has a flat end face terminating in an enlarged, approximate 45° tapered frusto-conical portion. The seamer roll is mounted on an axis nearly parallel to the plane of the previously unbent sheet metal margin to be closed, but displaced below that plane that only the frusto-conical surface and a narrow outer circular face portion may contact the margin m to be closed though 90°. The roll carriage holds the seamer roll in contact with this margin throughout the advance and return strokes, and (in the powered-roll embodiments) completes the burnished formed seam on the return stroke. This burnishing permits use of the machine, without adjustment or with minimal adjustment, for a substantial range of sheet material thicknesses, say 16 gage (0.062") to 28 gage (0.018").

DESCRIPTION OF THE PREFERRED EMBODIMENT

Figure 2:
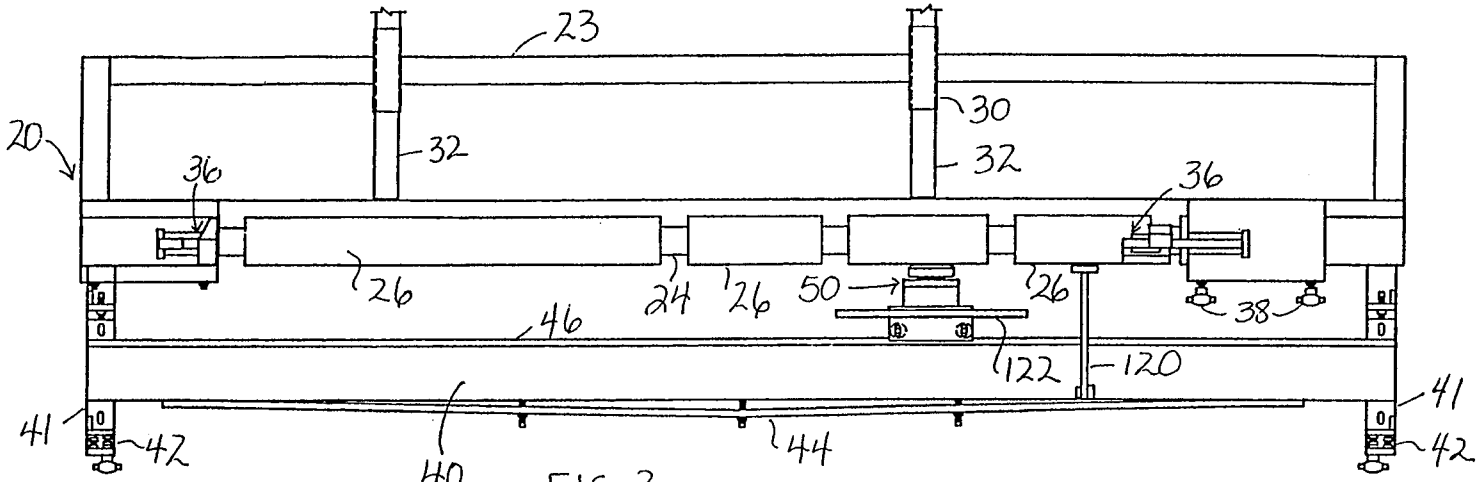
FIG. 2 is a plan view of the seam closing machine of FIG. 1, with the hinged duct-positioning stop shown lowered to horizontal.
Figure 1:
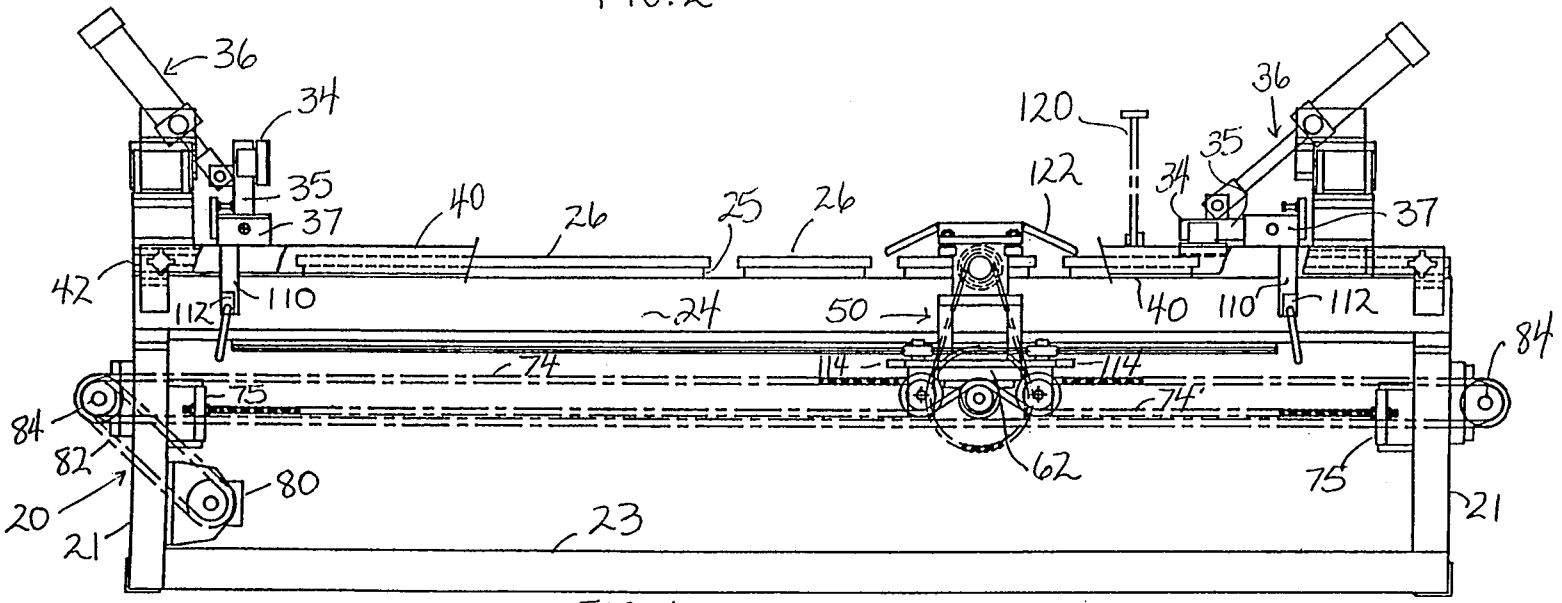
FIG. 1 shows a Pittsburgh seam closing machine embodying the present invention, generally in side elevation with its track beam broken away to show the seam-closer carriage. The hydraulic toggle clamps at its ends are installed in a plane inclined downward and aft at a 45° angle from vertical. The phantom lines illustrate a duct-positioning hinged stop, near the right end of the machine, in upwardly-raised position.
Figure 3:
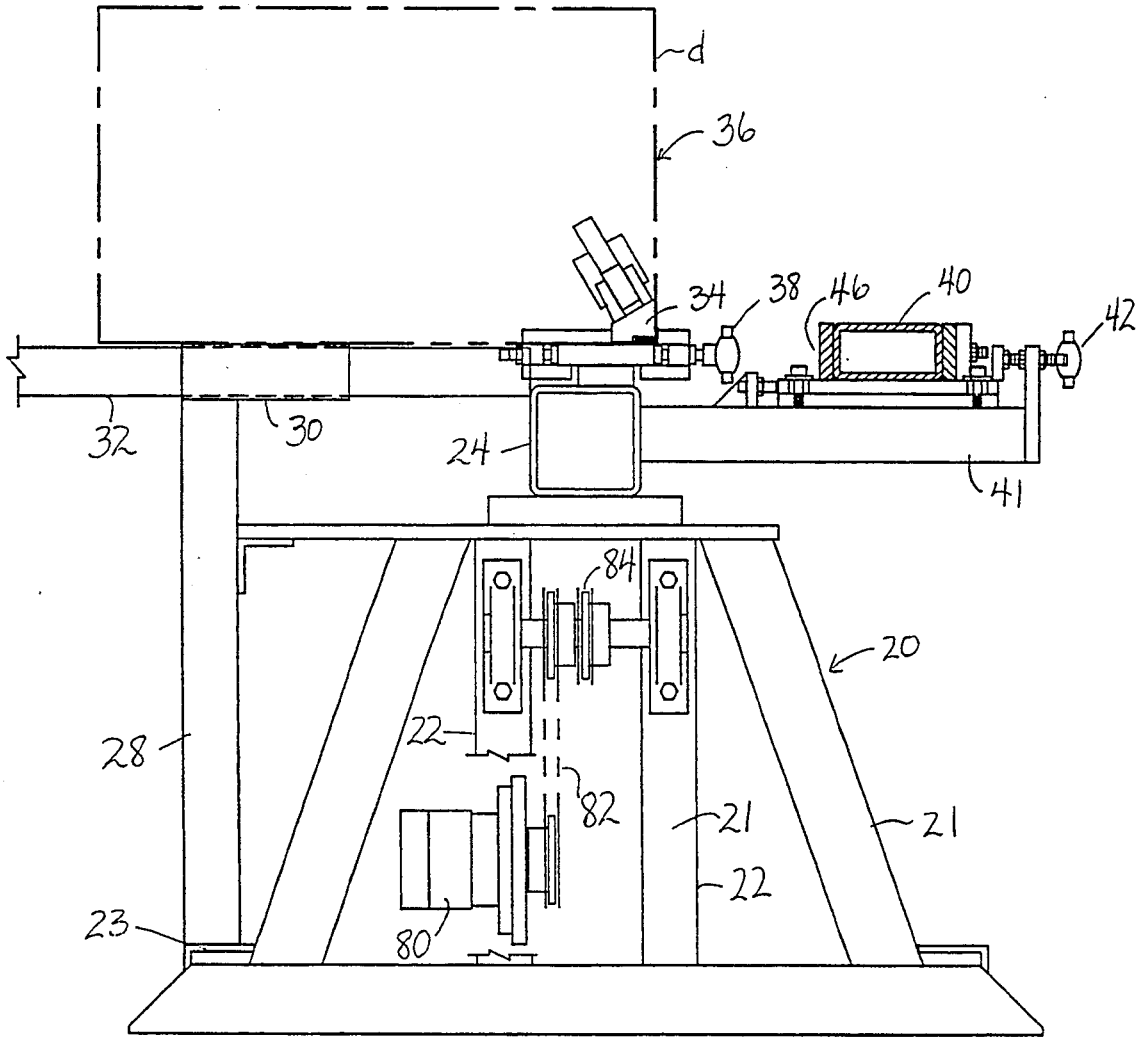
FIG. 3 is a left end elevational view of FIG. 1 with the carriage assembly removed. The phantom lines show the position of a duct, held at its far end by the clamping foot of the 45° toggle clamp at the right end of FIG. 1.
Figure 4:
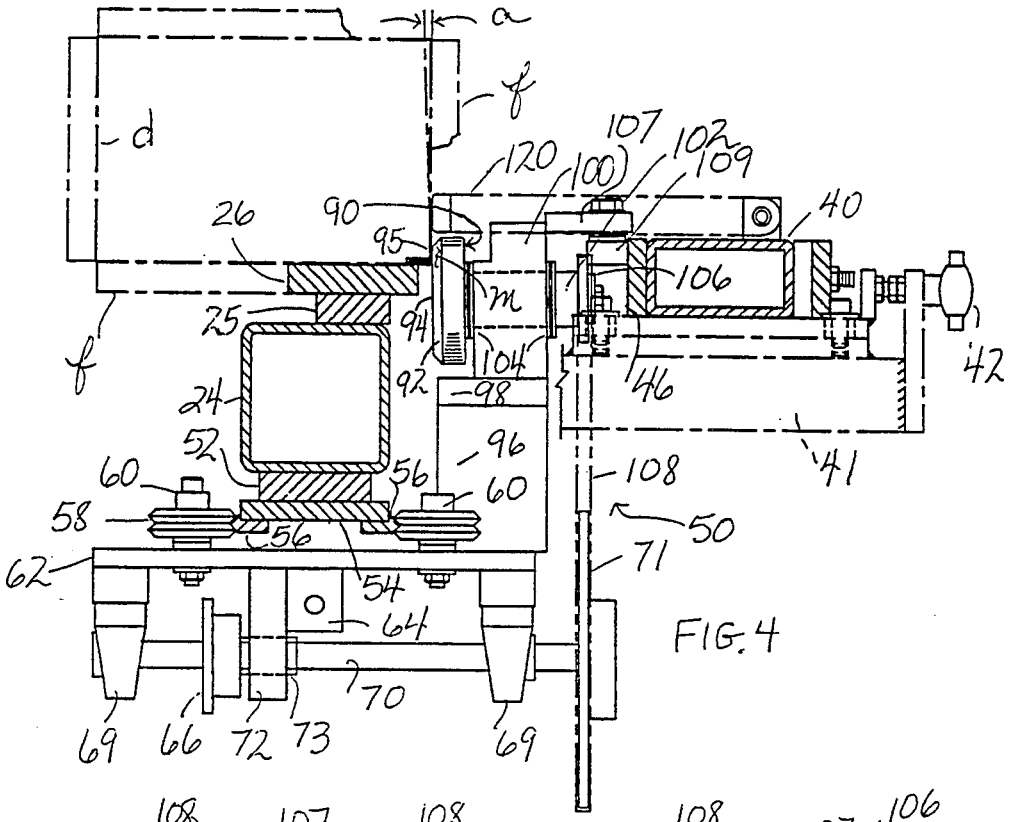
FIG. 4 is a typical cross-section of those portions of the machine which support the seam-closer carriage, shown in elevation.

Referring first to FIGS. 1, 2 and 3, there is provided a support frame generally designated 20 which comprises A-frame ends 21 framing pairs of vertical end members 22, longitudinal base members 23 and, supported on top of the A-frame ends 21, a longitudinal beam 24 which extends end-to-end and is seen in greater detail in FIG. 4. Welded on top of the longitudinal beam 24 is a series of aligned undercut duct support segments, each preferably made up of a narrower, shorter segment 25 and an overlaying wider, longer segment 26 as seen in FIGS. 2 and 4. These duct-support segments are so proportioned as to fit duct sections of conventional lengths, and particularly duct section d shown in phantom lines in FIG. 4, having integral end flanges which fit downward about the upper duct support segments 26.

Rising from the rear longitudinal base member 23 are several rear posts 28, topped by forward-extending sleeves 30 seen in FIGS. 2 and 3, which accommodate slidable, horizontal square tubular supports 32 for wide ducts d as seen in FIG. 3.

FIG. 3 also illustrates the nearly triangular pressure foot 34 of a duct end toggle clamp 36 installed at a 45° forward-and-down sloping plane. Except for their 45° angular installation and the shape of their clamping feet 34, these clamps are conventional planar-extending hydraulic clamps. At the left of FIG. 1 the toggle clamp 36 is in open position, in which the leg 35 (on which the foot 34 is mounted) is raised vertically from the clamp leg base 37. At the opposite end, the clamp leg 35 extends inward from its leg base 37, the clamp being in closed position. The entire clamps 36 are adjustably positionable spacedly from the ends of the machine by clamping onto the upper duct support segments 26, as indicated by the clamp screw handle 38.

A pressure-applying beam 40 is shown in FIG. 1 broken away to show the carriage carrying the seaming roll to be described. In FIGS. 3 and 4 the beam 40 is shown in sectional view mounted by horizontally-extending end supports 41 at its ends. The supports 41 include pressure-applying screws 42, used to vary the pressure exerted by the forming roll, as hereafter described, to compensate for the thickness of the sheet metal ducts whose margins are to be seamed.

As seen in the plan view FIG. 2, the beam 40 is made more rigid against deflection by a back-up bar 44. It is faced on the side opposite the bar 44 with a cold-rolled steel track bar 46, best seen in FIG. 4, which exerts the pressure of the beam 40 against the seamer roll mechanism hereafter to be described.

Figure 5:
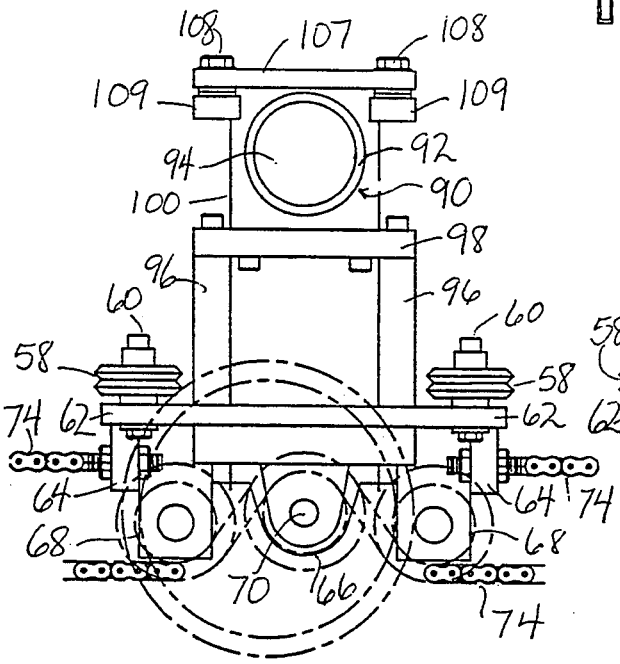
FIG. 5 is a left side view of the carriage of FIG. 4.
Figure 6:
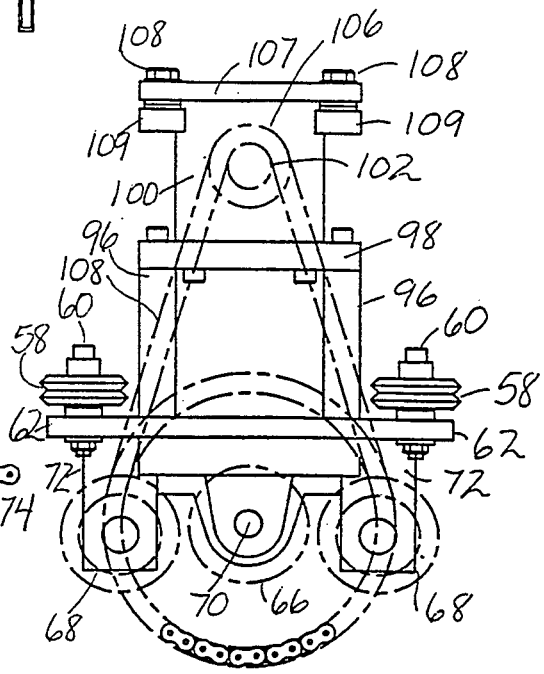
FIG. 6 is a right side view of the carriage of FIG. 4.

Seaming is performed by the carriage-born seaming roll mechanism generally designated 50, shown at the right of center of FIG. 1 and in greater detail in FIGS. 4, 5 and 6. Referring to FIG. 4, welded beneath the main longitudinal tubular beam 24 and extending the entire distance between the A-frame ends 21 are a pair of structural plates 52, 54; outstanding from beneath the lower plate 54 are full-length hardened tracks 56 whose tapered edges extend outward, to fit between the edges of pairs of tapered-edge carriage rolls 58 horizontally mounted for rotation on vertical pins 60 extending downward from near to the four corners of a rigid horizontal carriage plate 62. On these tracks 56 the carriage plate may move from one end of the machine to the other.

Welded beneath the left and right ends of the carriage plate 62 are chain mount lugs 64, best seen in FIG. 5. That figure also illustrates a central drive sprocket 66, mounted as seen in FIG. 4 and flanked by idler sprockets 68. The drive sprocket 66 is positioned between left and right pillow blocks 69 on a power shaft 70 whose right outer end mounts a large diameter sprocket 71 by which power is conveyed to the seaming roll 90 hereafter described. Referring to FIGS. 5 and 6, idler sprockets 68 (in the same plane as the drive sprocket 66 and not shown in FIG. 4) are mounted by stub shafts 73 supported by square-shaped lugs 72 welded to the underside of the carriage plate 62.

It will be apparent from FIG. 5 that as the carriage plate 62 is drawn by the upper run of a carriage chain 74 mounted in the chain mount lugs 64, flow of a chain (which may be the lower run of the same carriage chain 74 or if preferred a separate chain 74' shown in FIG. 1) beneath the idler sprockets 68 and over the drive sprocket 66 will rotate the power shaft 70 and thus drive the large sprocket 71 at its outstanding end.

Driving power is supplied by an electro-hydraulic, reversible motor 80, shown at the left A-frame mount in FIGS. 1 and 3. As seen in these figures, the motor 80 is connected by a chain 82 to powered and return drive sprockets 84 mounted on the exterior of the left and right A-frame ends 21. It is matter of choice whether a single chain 74 serves both to pull the carriage 50 and drive the seamer roll 90, hereafter referred to (passing between the drive sprocket 66 and the idler sprocket 68 on each side thereof as seen in FIG. 5), or whether a separate carriage-drive chain 74' fixedly mounted between end frame fittings 75 is utilized, as shown in FIG. 1, to turn the seamer roll 90 as the carriage 50 is moved.

Reverting to FIG. 4, and its left and right side views, FIGS. 5 and 6: the single seamer roll generally designated 90, which is the principal feature of the present inventive embodiment, is mounted so that only a narrow outer edge portion 92 of its flat circular forward face 94 makes final seaming contact with the duct margin which is to be tightly seamed. Sloping outward and aft from the forward face 94 is a 45° frusto-conical surface 95. A chosen seamer roll 90 has a $3\frac{1}{4}''$ outside diameter, a face radius of $1\frac{7}{8}''$ so mounted there, of which only the outer $\frac{1}{2}''$ is available to burnish the seamed margin. The roll 90 is hard chrome-plated and polished. This size has served successfully to burnish margins of 16 gage to 28 gage material and whose widths range from $\frac{1}{4}''$ to $\frac{1}{2}''$.

To position the seamer roll 90 at the height shown in FIG. 4, the following described structure has been found suitable:

A pair of upright plates 96, one of whose side surfaces is shown in FIG. 4 and both of which plates 96 are shown in FIGS. 5 and 6, are capped by a bridge plate 98; this mounts a rigid bearing-lined pillow block 100 through which passes a short shaft 102 at whose inward-presented end is mounted the seamer roll 90. At the designer's choice, conventional friction-minimizing, spacing washers may be mounted on a shaft 102 on either side of the pillow block 100 as shown; and/or a spring (not shown) may be inserted between the forward surface of the pillow block 100 and the aft surface of the seamer roll 90.

A small sprocket 106, mounted at the side of the pillow block 100 opposite the seamer roll 90, receives a driving chain 108, which powers the seamer roll 90 at a much more rapid speed of rotation than the driving shaft 70, depending on the relative size of the sprockets 71, 106.

A top bar 107 welded to the upper side of the pillow block 100 extends toward, and slightly above the level of the beam 40, as shown in FIGS. 5 and 6. From it, mounted on downwardly-extending bolts 108, are guide rolls 109 which bear against the forward face of the cold-rolled steel track bar 46, which serves as the forward face of the beam 40. Thus the pressure of the beam 40 is exerted, through the rolls 106, to the seaming roll 90.

Control of the movements of the seamer carriage mechanism 50 is achieved automatically regardless of the duct length, as follows:

Extending downward from the bases of the adjustable-position toggle clamps 36, for example from the bases 37 of the hinged legs 35 as shown in FIG. 1, are switch-mount plates 110 bearing electrical switches 112 whose actuator arms extend downwardly, to be actuated by switch actuator lugs 114 projecting from the opposite ends of the carriage plate 62. Since the toggle clamps 36 are adjustable by the clamp handles 38 to fit precisely the ends of the ducts to be flanged, this fit establishes the length of the advancing and returning strokes of the seamer mechanism 50. Thus, with the carriage-borne seamer mechanism 50 positioned so that it is immediately adjacent to the switch 112 at the left end of FIG. 1, power supplied to the electro-hydraulic motor 80 draws the chain 74 so that the carriage moves to the right, at a speed which is small compared to the rotary speed of the seamer roll 90, as hereafter discussed. When a switch actuator lug 114 on the carriage contacts the switch 112 at the right end of the duct, that switch 112 directs the motor 80 to reverse, driving the carriage 50 in the return direction until it contacts the switch 112 at the left side of the machine, which causes the motor 80 to stop. Hence, the positioning of the clamps 36 at the duct ends, as shown in FIG. 3, itself controls the length of the stroke of the carriage on both initial and return movements.

Figure 7:
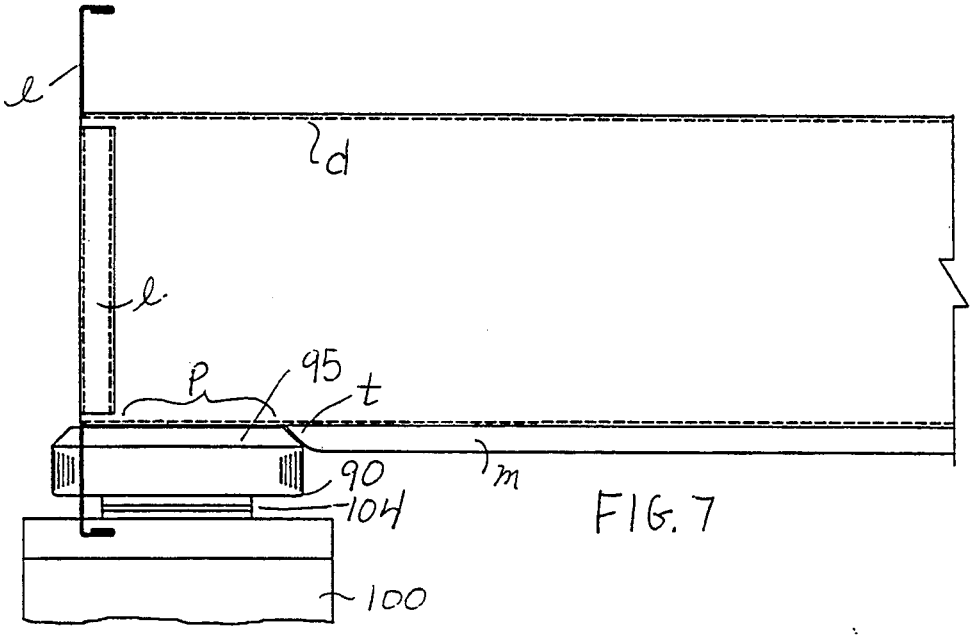
FIG. 7 is an illustrative sketch showing how the seaming roll of the present invention may fit closely near an integral-flanged end of a duct to be seamed, thus requiring a minimum of initial peening.

Referring to FIGS. 4 and 7, before a duct section d is secured by clamping, a section of the margin m to be seamed (see FIG. 7) must itself be peened to at least 90° to permit clamping adjacent to the seamer roll 90. This is made somewhat complex when the duct d has integral flanges e projecting as shown in FIG. 7. Using the seamer roll 90 of the present invention, much less peening is required than if several rolls were used in tandem, as with some prior art machines. Such minimal prepeening permits the duct section d to be clamped in position shown in FIG. 4, with the peened portion p of the margin m presented snugly against the seamer roll 90 at the left end of the duct.

To assure precise alignment of the duct pieces so being clamped with the line of seaming which is dictated by the machine elements, we provide a hingedly-removable stop 120 near the right end of the machine. When lowered into position, it projects as far as the face of the seamer roll 90 in starting position near the left end of the machine. The duct pieces, with at least their left end positions preliminarily peened, are fitted into position on top of the duct support segments 26 with their peened left ends abutted against the seamer roll 90 to be described and their right ends abutted against the hinged stop 120, shown in lowered position in FIG. 2, and in phantom in FIGS. 4, 11 and 13.

While it is feasible, after the clamping, to remove the hinged stop manually out of the way of the seamer carriage 50, this is done automatically where, as in FIG. 1, the carriage 50 is equipped with the ramp-like lift arm 122 which, as it moves to the right of FIGS. 1 and 2 automatically drives the hinge stop 120 upward out of the way of the carriage 50 in its advance and return strokes.

Referring to FIG. 4, it is seen that the angle at which the face 94 of the seamer 90 is presented against the seamed margin is a small angle—in the neighborhood of 1°—at which the shaft 102 slopes downwardly from horizontal. Inclining the face 94 of the seaming roll at this relatively slight angle appears to overcome "spring-back" of the material; it has proved to tighten the seaming of the margin m against the wall of the duct d; and it results in superior burnishing.

From FIGS. 4 and 7 it is seen that the axis of rotation of the seamer roll 90 is displaced so far below the duct to be seamed that only a narrow outer portion of its face 94 is operative in the final closing of the margin m against the wall of the duct d. Such axis of rotation is selected to utilize only an outer circular portion of the roll face 94 whose width may approximate the width of an average margin m to be seamed.

Referring now to FIG. 7, when the seamer roll is introduced against a pre-peened portion p of the margin m, a small transition portion t of the margin overlays part of the sloping edge of the seamed surface 95 of the seaming roll 90. As the seamer roll 90 advances to the right, as shown by the short arrow in that figure, the seamer roll 90, rotating in the direction shown by the curved arrow, wipes the margin m upward from substantially horizontal at point a of FIG. 8, to a substantially 45° angle at point b, and thence to a substantial 90° (or 91°) angle at point c; after which its rotation burnishes the margin m and seals it very tightly against the duct wall d. This burnishing is due in part to the relatively rapid rotational speed of the seamer wheel 90 as shown by the longer curved arrow; its substantially tangential component is in a direction opposite to the shorter advance speed arrow, and preferably is substantially 3½ times as great. As the result, the advancing of the wheel 90 does not tend to crush the margin m in the direction of advance movement; to the contrary, the margin m is drawn by a frictional force in a direction opposite to the advance movement. This effects a smooth transition of the margin m from horizontal as shown in section a of FIG. 9 (corresponding to section a in FIG. 8) to section b of FIG. 9 (corresponding to the 45° position of section b of FIG. 8).

Figure 10:
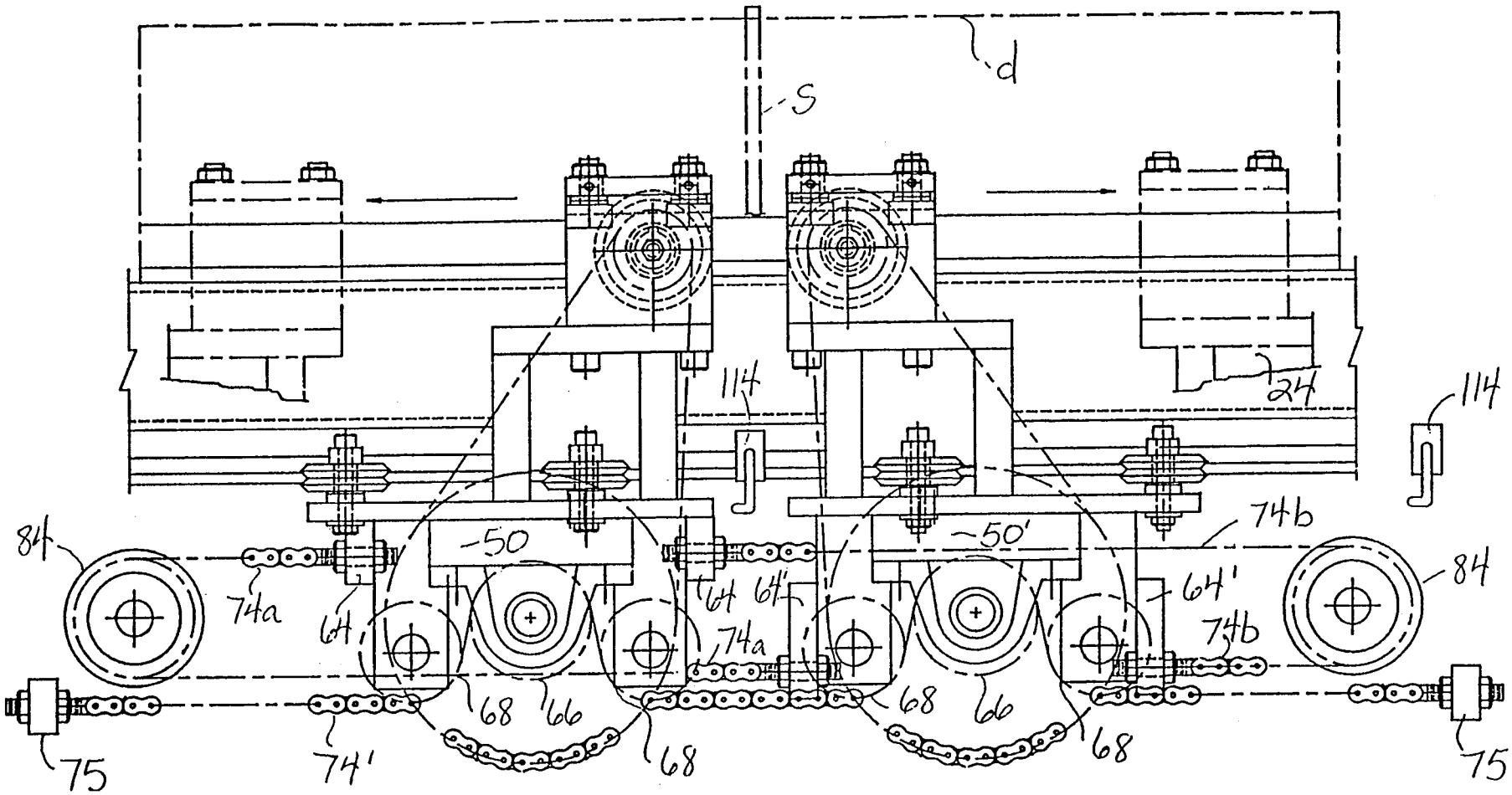
FIG. 10 illustrates a dual-carriage version of the present invention, adapted to move the carriages in opposite directions to close the seam of a duct of the type having an outstanding central reinforcing flange.

Turning now the modified embodiments of invention:

FIG. 10 shows a seamer machine with two carriage mechanisms 50 powering two seamer rolls 90, this construction being especially designed for seaming those ducts d' which have central exterior stiffeners s, both the duct and stiffeners being shown in phantom lines. The parts of the mechanism are substantially identical with those previously described, for which reason the same part numbers are used; the difference is the offset assembly of the carriage-borne parts as seen in FIG. 10, so that the seamer rolls 90 can approach very close to center. The only significant difference is that in case of the seamer 50' at the right side of FIG. 10, the chain mount lugs 64' extend much farther downward from the carriage plate 62, to permit attachment to the lower return run of the chain 74, instead of to its upper run. Also in this system, use is made of a carriage drive chain 74, made up of two chain segments (to be described) along with a separate fixed chain 74' which functions to rotate the seamer rolls 90 in the same manner as does the fixed chain 74' of FIG. 1. The two carrier drive chain segments are: a first chain segment 74-a which extends from a leg 64 of the left carriage 50, down around the left drive sprocket 84 to a deeper lug 64' on the right carriage 50; and second chain segment 74-b which extends from the other deep lug 64' of the right carriage 50' up around the right drive sprocket 84 to the second lug 64 of the left carriage 50. As in FIG. 1, a fixed chain 74' is secured at its ends to end frame fittings 75. Although this chain remains fixed, it passes up, over and down around the drive sprockets 66 of each of the carriages 50, being confined at both sides by the adjacent idler sprockets 68. Starting is controlled by a manual switch, not shown; reversing is controlled by contact of a carriage plate 62 with the end switch 114; and stopping is controlled by contact of one of the carriage plates 62 with the centrally-positioned switch 112.

Figure 11:
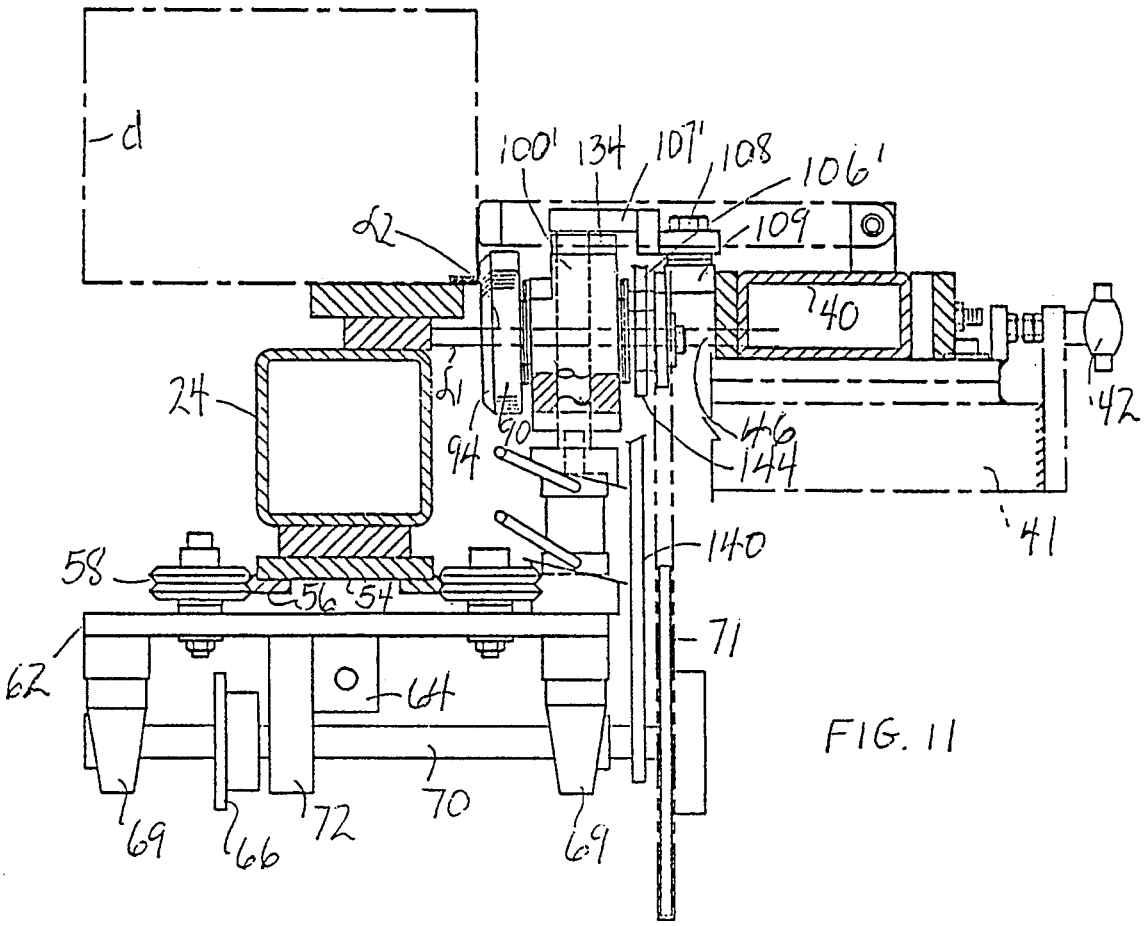
FIG. 11 is a view generally similar to FIG. 4 of a modified embodiment of the invention, in which the seaming roll is positioned at a lower level for bending the outstanding margin to a 45° angle on its advance stroke, and it is raised by a hydraulic actuator to a higher position, shown in phantom lines, for seaming to a 90° closed position on a return stroke.
Figure 12:
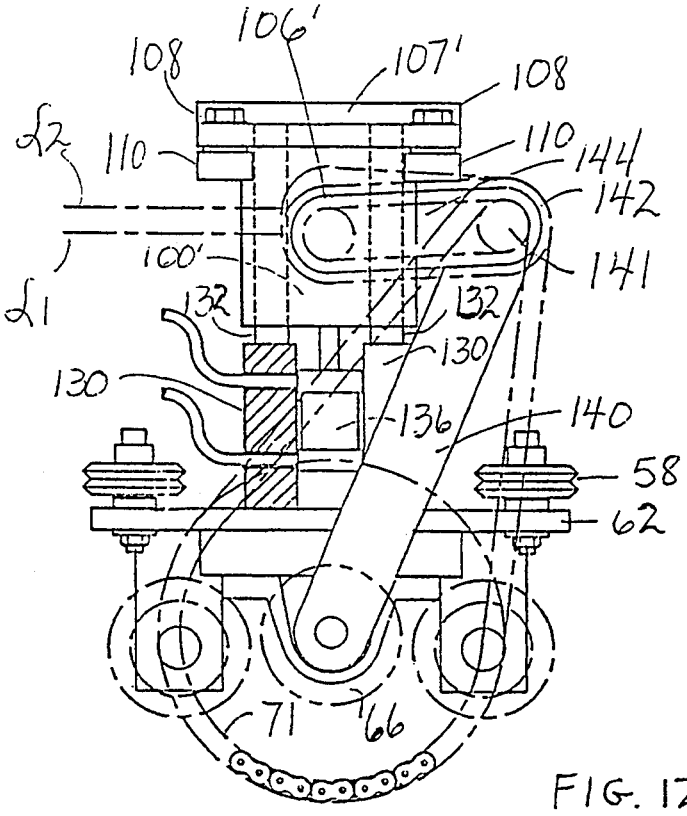
FIG. 12 is a right side view of FIG. 11.

Another embodiment of the present invention is shown in FIGS. 11 and 12; this embodiment may be found useful where heavy gauges of sheet metal are to be seamed, or where precise burnishing may not be required. In this embodiment the seaming roll starts at a lower elevation on the advance stroke, bending the margin m only to about 45°; on the return stroke the level of the seaming roll is raised to complete the seaming to 90°. In greater detail:

For the advance stroke, the axis of the seaming roll is at a substantially lower level $L_1$, which presents only the 45° sloping edge surface 95 of the seamer roll 90 against the margin m, to raise it to a 45° angle from horizontal. On the return stroke however, the axis is raised to the level $L_2$. Such raised position of the roll being shown in phantom lines; this presents the outer circular area of the forward face 94 (in the same position as throughout the FIG. 4 embodiment), to complete the seaming on the return stroke. This arrangement permits more gradual bending, which may be useful for heavy gauges of metal, but lessens the burnishing effect which in the FIG. 4 embodiment takes place throughout the advance stroke as well as the return stroke.

Mechanism by which the seamer roll 90 is so raised and lowered is shown as follows: On the carriage plate 62 are mounted two spaced-apart pedestal blocks 130, each bearing a sturdy round vertical pin 132. On these pins reciprocate a pillow block 100', bored to permit the pins 132 to pass through; this pillow block 100' mounts the shaft for the seamer roll 90. Across the tops of the pins 132 is mounted a cross bar 134, to which is welded the bar 107 which bears the rolls 109 which are presented against the track bar 46.

Mounted on the carriage shaft 70 just inward of the large sprocket 71 is a pivoted arm 140 which leads diagonally upward to a stub shaft 141 bearing two sprockets 142, 142', the first being driven by the large sprocket 71 and the latter being connected by chain to a sprocket 106' on a shaft of the seamer roll 90.

A hydraulic linear actuator 136, mounted vertically between the pedestal blocks 130, is actuated at the end of the advance stroke (that is, just before the beginning of the return stroke) to raise the pillow block 100' from the shaft level $L_1$, shown in FIG. 11, to the higher level $L_2$. As the return stroke is completed, the pressure to the hydraulic actuator 136 is reversed, so that the pillow block 100' lowers as shown in FIG. 12.

Figure 13:
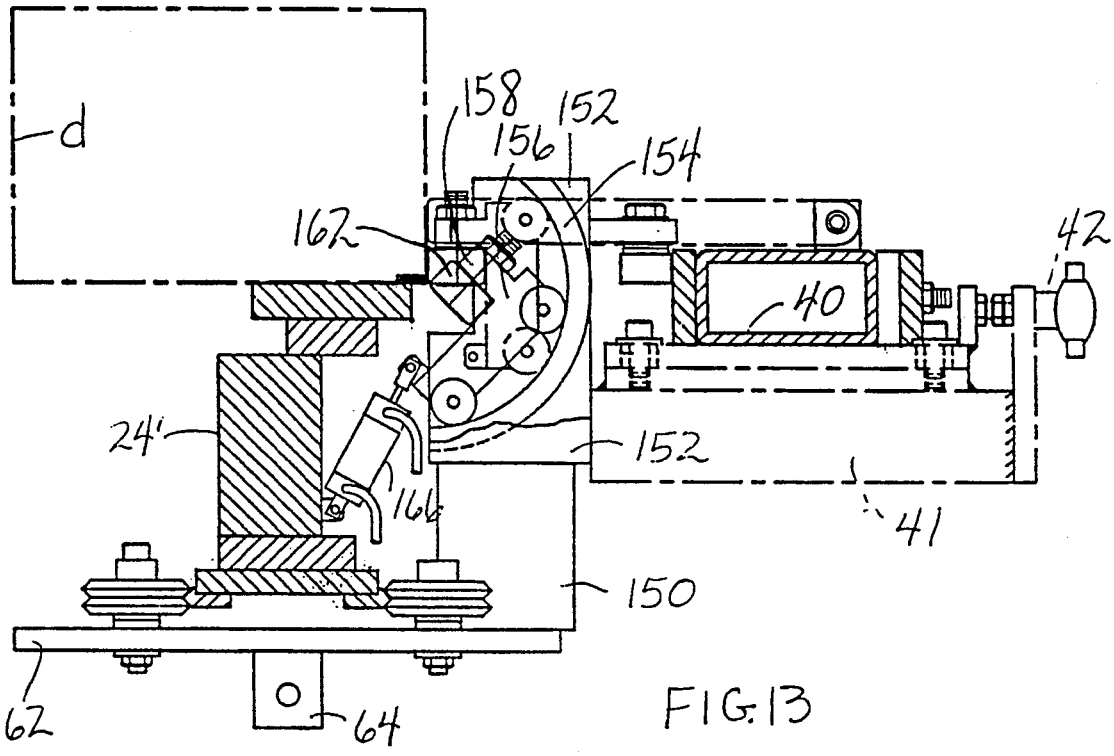
FIG. 13 shows a further modified embodiment using the same surface of the seamer roll for both first and return strokes. Shown with the seamer roll unpowered, it forms the margin to 45° on a first stroke and completes the forming to 90° on the return stroke.

While FIGS. 11 and 12 show powering of the seamer roll 90, in an alternative construction suited for forming the lighter sheet metal gages, the seamer roll may be permitted merely to idle, resulting in great simplifications—the shaft 70 and all the sprockets 71, 141, 142 and their chains are eliminated as in the FIG. 13 embodiment. Inasmuch as throughout the entire advancing stroke the margin m is raised only to a 45° position, and through the entire return stroke bending to 90° is completed, idling the seamer roll 90 may be found sufficient; but the desirable burnishing effect, achieved by the principal embodiment of the invention, FIG. 4, will be lost.

Another embodiment of the invention is shown in FIG. 13 in which the carriage plate 62 has nothing beneath its lower surface other than the chain lugs 64 by which it is drawn to perform the advance and return stroke. Because of space requirements of this embodiment, a narrow block 24' is substituted for the square tubular beam 24 of the prior embodiments. At the right edge of the carriage plate 62, mounted on a lower block 150 are a pair of spaced-apart end plates 152 between which are welded an arcuate track 154 of concave curvature. On this track is a small wheeled truck 156, shown principally in its lowered position is driven from a lower position to an upper position. Hingedly attached to the block 24; a hydraulic linear actuator 166, when in retracted position, maintains this lowered position of the truck 156.

From a lug 158, projecting from the carriage 156 is a shaft 160 at a 45° angle to horizontal.

On the shaft 160 is a freely rotating cylindrical roll 162 whose outer cylindrical forming surface is presented along the line at which the margin m is to be bent; it bends the margin m up to a 45° angle as the carriage plate 62 is carried along its advance stroke.

The hydraulic linear actuator 166 is then pressurized to extend it and drive the truck 156 to the upper part of the concave track 154, presenting its shaft 160 vertically downward so that the cylindrical roll surface 162 now is presented vertically; in this position on the return stroke it completes forming the margin m to a 90° position. At the close of the return stroke, the actuator 166 is again returned to the lower position, so that the cylindrical forming surfaces of the seamer roll 162 is again presented at a 45° angle for next use in an advance stroke.

Advantages of Preferred Embodiment

Figure 8:
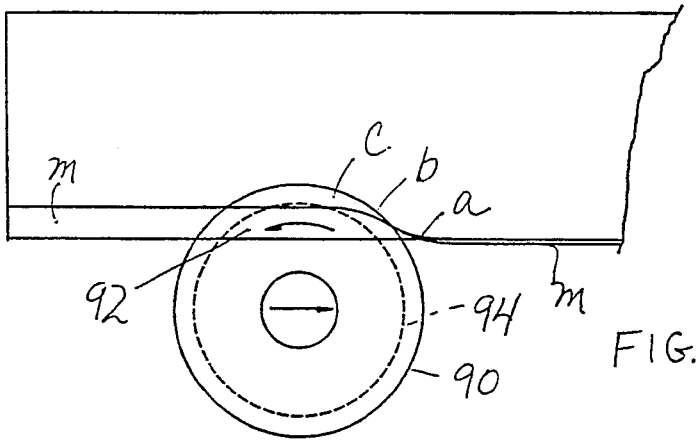
FIG. 8 illustrates how, in the preferred embodiment with the seaming roll powered to rotate so that its upper margin of the seamer roll face moves substantially opposite to the carriage direction of advance, the 45° conically tapered surface of the seaming roll lifts the margin to be seamed upward and feeds it to the upper circular margin of the roll face.
Figure 9:
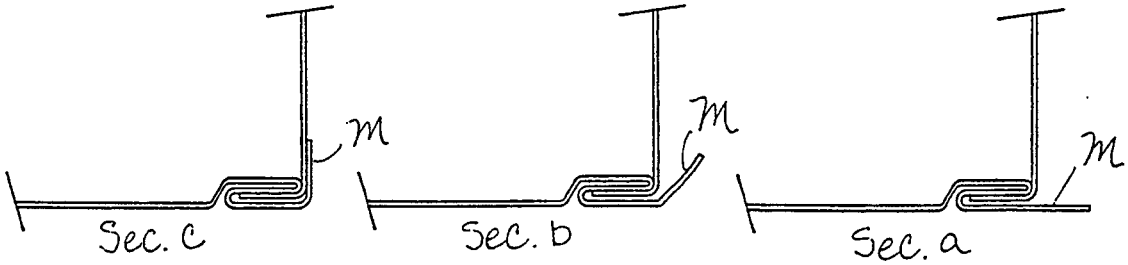
FIG. 9 illustrates the progression of bending the margin to be seamed corresponding to the points a, b and c of FIG. 8.

From FIGS. 7 and 8, it is seen that since the axis of the seamer roll 90 is well below the margin m, the frusto-conical surface 95 commences lifting contact of the margin m at point a of FIG. 8, while the narrow edge portion 92 of the forward face 94 of the forming roll does not make full contact until point a. With roughly the proportions shown, an advantageous rotational speed of the narrow edge portion 92 of the forward surface 94 of the roll 90, which makes nearly tangential contact with the margin m as shown in FIG. 8, is roughly 3.5 times the speed of linear advance of the roll, shown by the short arrow at the FIG. 8 roll axis. The results are here summarized:

(a) Where the roll's frusto-conical 45° sloping outer edge 95 makes first contact to lift the flange, advance movement of the roll is more than compensated for by the reverse component of the rotation vector (the curved arrow in FIG. 8); so that the previously unbent flange is effectively wiped upward.

(b) At the area of burnishing with the front face of the roll, the 3·5:1 ratio of this reverse component to advance speed applies burnishing forces, which seal the margin 90 tightly and smoothly against the wall of the duct. The progression of forming shown in FIG. 9 takes place in the short distance of advance illustrated in FIG. 8; the outstanding edge of the margin m moves from level at point a, to an approximate 45° bend at point b, to the 90° bend at point c, all in the relatively short advance distance from point a to point c.

Even if the forming roll 90 were not powered, if it is free to rotate as it is advanced, the tapered surface of its frusto-conical portion 95 will slide partly under and pry upward on the margin m to be closed as shown in FIG. 7, bending it progressively from horizontal to approximately 45° at point b of FIG. 8 and thence to approximately 90° at point c of that figure.

However, when the forming roll 90 is powered to rotate in the sense shown by the curved vector arrow of FIG. 8, several pronounced advantages are gained. Selecting a rotational speed so that the portion 92 of the roll face adjacent to its outer edge moves approximately 3½ times the speed of linear advance, and in the opposite sense (as illustrated):

(a) A tangential component of the rotation will exceed the advance speed by about two and a half times, serving to burnish the margin after being bent up, thus sealing it tightly; and (b) Where the margin m remains unbent despite the movement of the roll 90 into it, the outer frusto-conical surface 95 of the roll 90 advances into the previously unbent margin as at point a; thus, the frictional force applied to the margin's under surface, tends to draw the margin m in the sense opposite the direction of advance. But for this powered rotation, advancing the roll 90 would tend instead to compress and possibly dent the margin m into which it is being advanced.

The quick transformation of the margin m from outstanding through 45° bend to 90° permits the remainder of the advance stroke to serve for burnishing, as well as the entire return stroke. This is believed to make the chosen construction suited for seaming all thicknesses of sheet metal commonly used for ducts either without any adjustment of the track 40 or at most with a minimum of adjustment as the machine is used alternatingly to seam metal gages of the greatest difference of thickness.

As various modifications may be made in the constructions herein described and illustrated without departing from the scope of the invention, it is intended that all matter contained in the foregoing description or shown in the accompanying drawings shall be taken as illustrative rather than limiting.

We claim:

1. For closing the outstanding margin of the pocketed member of a rectilinear Pittsburgh-type joint against a longitudinal wall member of such joint, the wall member having a substantially 90° flange inserted in the pocket of such pocketed member, the pocketed member including an originally outstanding planar margin portion to be seamed from such original plane to a closed position against such wall member, a seaming machine of the closer-roll type comprising support structure including means to clamp together thereon an end of such pocketed and wall members along a longitudinal line of seaming, track means parallel to such line of seaming, a carriage operable along said track means, bearing a single rotatable forming roll, means to drive said carriage in a initial stroke therealong and in a return stroke, means to so present a forming surface of said roll against such outstanding margin as to form it at least substantially 45° from such original plane during at least a portion of said forward stroke, and means to present against such margin a forming surface of said roll at such angle through said return stroke to form such margin substantially the remainder of 90°, whereby to press such margin firmly against such wall member.

2. The machine as define in claim 1 wherein the forming roll has a planar circular end face, and said roll is mounted for rotation on an axis nearly parallel to the plane in which such planar margin portion was originally outstanding, said axis being displaced from said plane to the side thereof opposite the direction in which such margin is to be bent, the amount of said displacement being less than the radius of said planar end face, whereby an outer ring-like portion of said roll end face is pressed rotatably against such margin.

3. The machine as defined in claim 1, together with means to rotate said forming roll in one sense during said initial stroke and in the opposite sense during said return stroke, whereby such rotating pressure is exerted opposite to the direction in which said roll is advanced, both on said initial stroke and on said return stroke.

4. The machine as defined in claim 2, whereby such rotating pressure is exerted opposite to the direction in which said roll is advanced, both on said initial stroke and on said return stroke.

5. The machine as defined in claim 4, wherein said forming roll has a frusto-conical surface extending to a greater diameter from said planar end face, whereby as said carriage is driven along said track means on an initial stroke, said frusto-conical surface progressively first underlies a portion of such originally outstanding planar margin and then lifts and bends such portion, thereby to feed it beneath the ring-like face portion of said forming roll.

6. The machine as defined in claim 1, wherein said track along which said carriage is operable is beneath the said support structure having said means to clamp, together with further track means outboard of and adapted to bear against said carriage, and whereby to exert pressure on said forming roll.

7. The machine as defined in claim 1, wherein said means to drive said carriage includes a reversible motor, switch means to initiate driving said carriage in an initial stroke, adjustable-positioned switch means to reverse said motor when the carriage has completed a chosen length of said initial stroke from an original position, and switch means to stop driving said carriage when it has so returned to a chosen stop position.

8. The machine as defined in claim 1, wherein the forming roll has a planar circular end face and a frusto-conical surface extending to a greater diameter from said planar end face, and said roll is mounted for rotation on an axis nearly parallel to the plane in which such margin portion was originally outstanding, said axis being displaced from said plane, during said initial stroke, in a first position substantially equal to the radius of said roll's circular end face, and being displaced from said plane, during said return stroke, in a second position substantially less than the radius of said circular end face, together with means to establish and maintain said first and second axis positions during said initial stroke and said return stroke respectively, whereby during said initial stroke such outstanding margin is formed only to the angle of the roll's frusto-conical surface and on said return stroke is pressed firmly against such wall member by an outer portion of said circular end face.

9. The machine as defined in claim 1, wherein during the entire said initial stroke a forming surface of said roll is so presented as to form such outstanding margin substantially half of 90°, together with means including a linear actuator operable at the beginning of said return stroke, to so reposition said forming roll to form such outstanding margin substantially the remainder of 90°.

10. The machine as defined in claim 9, wherein the forming surface of said forming roll is a cylindrical surface formed about an axis of rotation, and wherein said means including a linear actuator further includes a concave arcuate track segment rigidly supported by said carriage and extending parallel to said track means, and means, projectable by said linear actuator along the concave surface of said segment, to support said forming roll by and rotatably about its axis of rotation, whereby at the commencement of said return stroke, said linear actuator means moves said axis of rotation from an angularity of substantially 45° to such originally outstanding position of such margin, to substantially 90° thereto.

* * * * *